US005611295A

United States Patent [19]

Stables

[11] Patent Number: 5,611,295

[45] Date of Patent: Mar. 18, 1997

[54] ANTI-SPIN/TURNING ENHANCER FOR PERSONAL WATERCRAFT

[76] Inventor: Lloyd J. Stables, 3799 N. Ridge Rd., Port Clinton, Ohio 43452

[21] Appl. No.: 536,003

[22] Filed: Sep. 29, 1995

[51] Int. Cl.[6] ..... B63B 39/06

[52] U.S. Cl. ..... 114/126; 114/283

[58] Field of Search ..... 114/125, 126, 114/283, 285, 288, 270, 271

[56] References Cited

U.S. PATENT DOCUMENTS

| | | | |
|---|---|---|---|
| 2,757,629 | 1/1956 | Wiltse | 114/125 |
| 4,159,691 | 7/1979 | Paxton | 114/290 |
| 4,597,348 | 7/1986 | Otakar | 114/140 |
| 5,235,926 | 8/1993 | Jones | 114/126 |
| 5,237,953 | 8/1993 | Mannerfelt | 114/288 |
| 5,313,907 | 5/1994 | Hodges | 114/290 |

*Primary Examiner*—Jesus D. Sotelo

[57] ABSTRACT

Two non-movable plates mounted on the outside rear of a personal watercraft, extending below the lower edge of the hull. These plates provide lateral resistance and prevent the hull from sliding out at the rear which could initiate a spin. As these plates move laterally while in a turn they are designed not to adhere to the water by vacuum. When returning to a straight course out of a turn, the necessity to over steer is greatly reduced and the momentary loss of control is eliminated. Being considerably more narrow than the O.E.M. sponsons which they replace, lift is reduced and the pump intake remains more deeply engaged thus providing more steering control during high speed turns and manuevers. The attributes mentioned above add greatly to the safety of operation of a personal watercraft.

6 Claims, 2 Drawing Sheets

ANTI-SPIN/TURNING ENHANCER FOR PERSONAL WATERCRAFT

BACKGROUND-FIELD OF INVENTION

This invention relates to an anti-spin device for improving the directional control of jet powered personal watercraft with V and semi-V hull configurations.

BACKGROUND-DISCUSSION OF PRIOR ART

Spin out is an inherent problem of personal watercraft due to their more forward center of gravity. This problem is especially visible when making high speed tight turns.

Side sliding was addressed in U.S. Pat. No. 5,235,926 to Jones on Aug. 17, 1993 where dual pivotally attached metal fins were mounted to the rear of a flat bottomed boat. This would seem to be a very logical approach for larger multi passenger boats with conventional cockpits. Because of the difference in nature between conventional boats and personal watercraft, specifically the closeness of the operator of a personal watercraft to the rear of the craft, a serious safety hazard would exist if a design of this type were used. An operator could easily fall back upon exposed metal fins causing severe injury.

A side slipping situation was also addressed in U.S. Pat. No. 5,313,907 to Hodges May 24, 1994 where rails were mounted along the bottom outside corner of the boat hull, extending downward. The rails in his FIGS. 9 & 10 extend approximately half the length of the hull. Although side slipping would be reduced, the steering capabilities would be seriously de-tuned as rails of this length would hold the craft in a straight course.

OBJECTS AND ADVANTAGES

Accordingly several objects and advantages of my invention are;

(a) to considerably reduce spin out during high speed turns (b) to enhance steering control during and when coming out of a high speed turn.

(c) to eliminate the need to over-steer when coming out of a high speed turn (d) to furnish a device which does not create a safety hazard because of its location and minimal extension away from and below the craft.

(e) to accomplish precise control in a turn without a device of such extended length that horsepower and speed are lost working against such a device.

(f) to furnish a device that is virtually indestructable requiring no maintenance for its protection from corrosion, delamination and color fading.

(g) to furnish a device that cannot be shattered or broken to a point that sharp edges would create a safety hazard Further objects and advantages of my device will become more apparent from a consideration of the drawings and my ensuing description

DRAWING FIGS. 1–5

REFERENCE TO NUMERALS IN DRAWINGS

| | |
|---|---|
| 10 | outer plate |
| 11 | inner plate |
| 12 | mounting holes |
| 13 | hull of watercraft |
| 14 | radius-outer plate edge |
| 15 | bottom edge of hull |
| 16 | degree of angle |
| 17 | reinforcement washer |
| 18 | personal watercraft |
| 19 | pebble textured finish |
| R-1 | radius 1 |
| R-2 | radius 2 |
| R-3 | radius 3 |
| R-4 | radius 4 |

DESCRIPTION OF INVENTION

Figure 3:
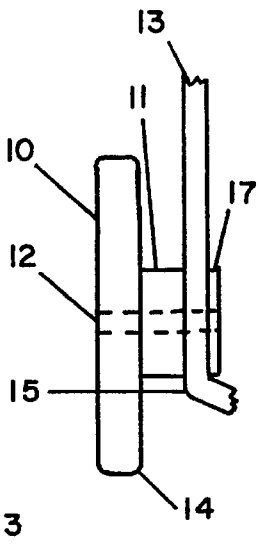
FIG. 3 is an end view of my anti-spin device-right assembly.
Figure 2:
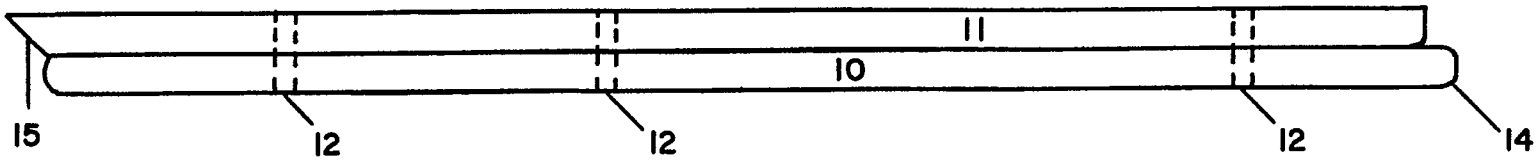
FIG. 2 is a top view of my anti-spin device-left assembly.
Figure 4:
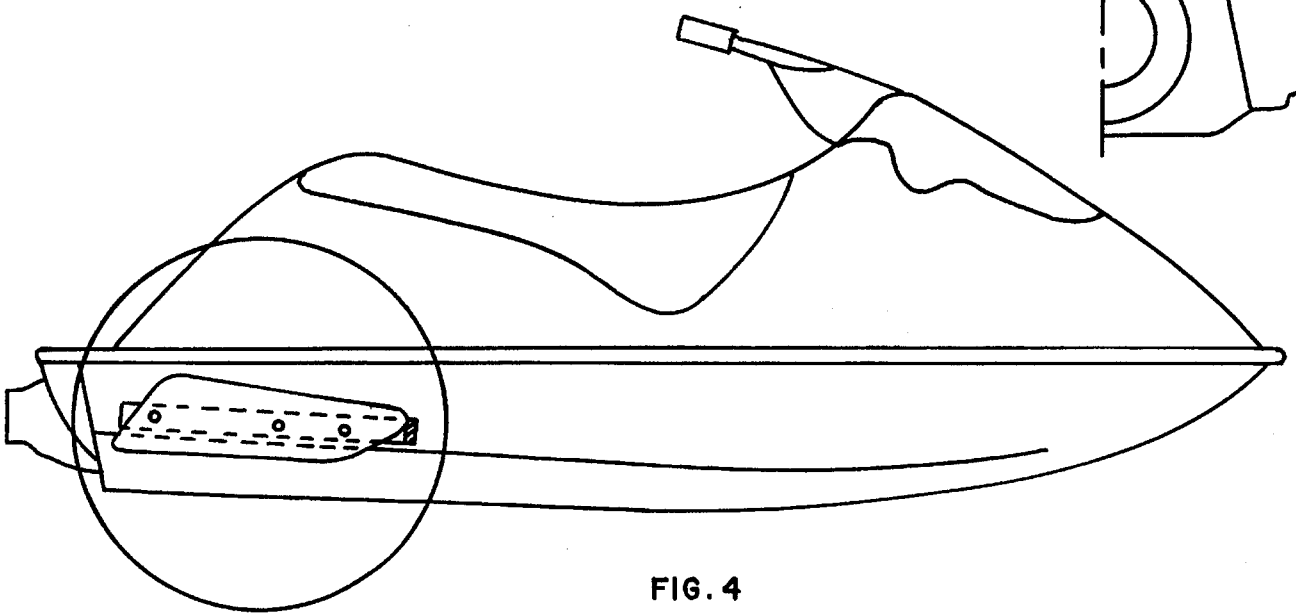
FIG. 4 is a right side view of a personal watercraft showing my anti-spin device and its relative mounting location.

FIG. 4 shows a side view of my device as mounted on the right side of a personal watercraft. The outer plate (10 in FIG. 3) is mounted to the hull (13 in FIG. 3) with the inner plate (11 in FIG. 3) mounted between it and the hull.

Figure 5:
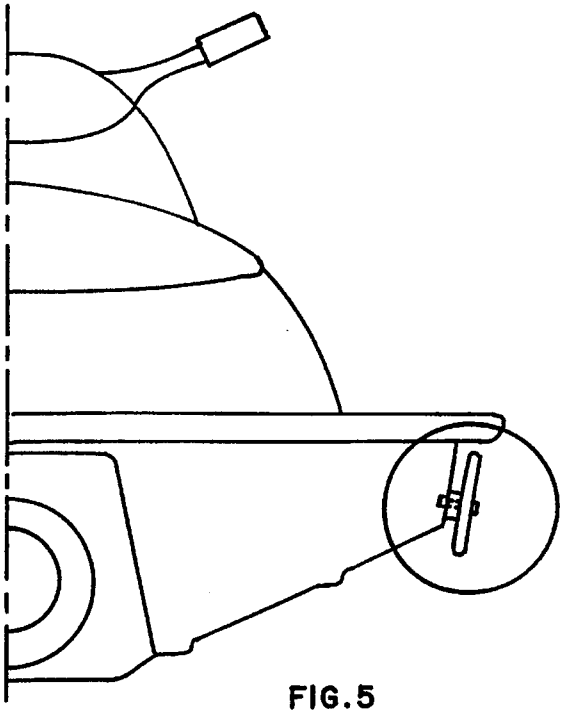
FIG. 5 is a right rear view of personal watercraft showing my anti-spin device and its relative mounting location.

This embodiment consists of a pair of inner and outer plates (10 & 11 in FIG. 1) mounted on both sides of the craft. As shown in FIGS. 3, 4 & 5 the outer plate (10 in FIG. 1) will extend below the bottom outside edge of the hull (15 in FIG. 3) approximately one inch but is not limited to that dimension.

These devices are mounted to the hull using existing holes (12 in FIG. 3) from which O.E.M. sponsons were removed. These devices may also be stud mounted on existing studs from which O.E.M. sponsons were removed.

Figure 1:
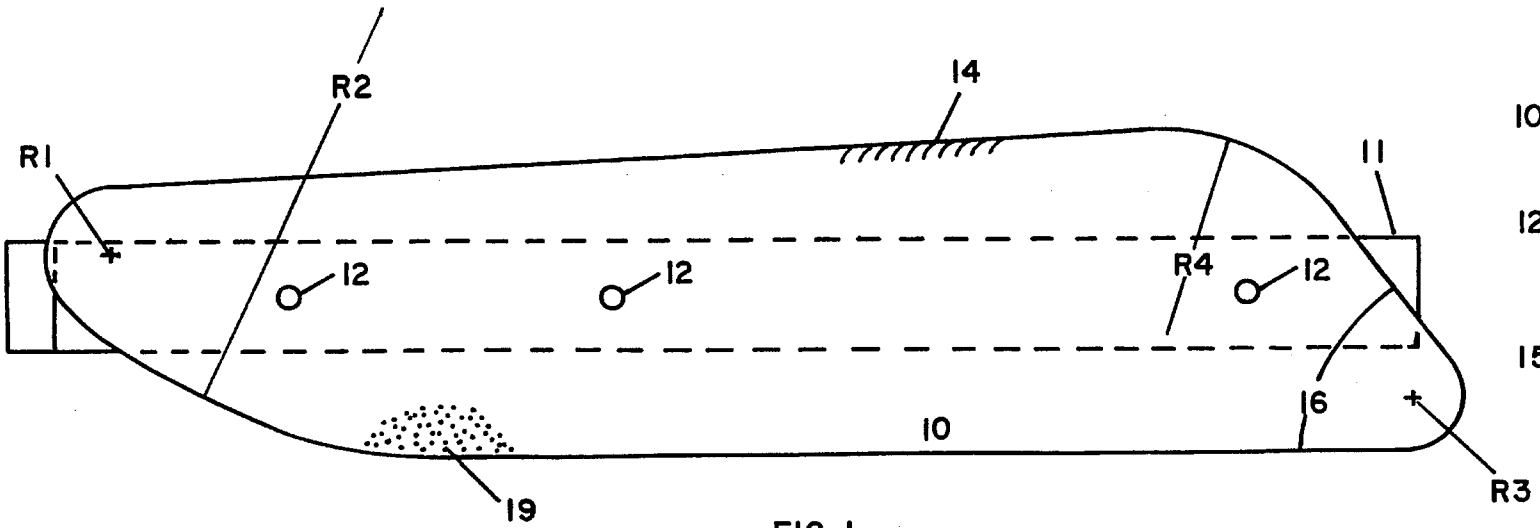
FIG. 1 is a side view of my anti-spin device-left assembly.

The fastening devices for mounting, for safety purposes, must not protrude more than ¼ inch above the outer plane of the outer plate (10 in FIG. 1). It must be round and smooth in nature. As an example a carriage bolt or truss head bolt may be used. A hex head bolt may not be used. When stud mounting, the studs may not protrude thru the outer plate (10 in FIG. 1). As an example a stud may be shortened, a coupler nut added and a truss head screw screwed into the coupler nut thru the inner and outer plates (10, 11 in FIG. 1).

Because of so many variations in O.E.M. mounting and continual changes by O.E.M. manufacturers this inventor will suggest the best mounting application at a given time. I would not specify a given method at this time because it could become non-feasable at any time.

When possible, reinforcement such as large finishing washers (17 in FIG. 3) should be used inside the hull. Any additional reinforcement will be at the owners discretion. All hardware will be stainless steel and in no case smaller than ¼ inch in diameter.

The outer and inner plates (10, 11 in FIG. 1) are manufactured from ½ inch thick high density polyethelene or similar material in sheet form. These devices are saw cut with the outer plates (10 in FIG. 1) being routed using a 0.20 in. router bit. they may also be injection moulded with the rounded outer edges formed by the mould. The surface of the outer plate (10 in FIG. 1) contains a moulded in pebbled finish (19 in FIG. 1 ). This finish contains approximately 1500 indentions per square inch at a depth of 0.015 inch.

The actual length of the assembly can vary from 18 to 30 inches coinciding with the length of the O.E.M. sponson which it replaces. The length of the backing plate (11 in FIG. 1) would be adjusted accordidngly. The radii (R1 thru R4 in FIG. 1) are as follows: R1—0.90 in. R2—6.75 in. R3—0.70 in R4—2.50 in. The angle (16 in FIG. 1) is 52 degrees. The outer plate (10 in FIG. 1) is 2.25 inches high at the front, measured from the beginning of the top flat to the extended plane of the bottom edge. The outer plate (10 in FIG. 1) is 4.10 inches high at the rear, measured from the end of the top flat to the bottom. The height of the inner plate (11 in FIG. 1) is 1 ½ inches and extends beyond the outer plate (10 in FIG. 1) as shown in FIG. 1. Drilled holes are centered in the height of the inner plate (11 in FIG. 1). All holes (12 in FIG. 1) are ¼ inch or larger corresponding to O.E.M. sponsons removed. The degree of slope of the top edge of the outer plate (10 in FIG. 1) will vary depending on the length of the plate (10 in FIG. 1).

Operation

As shown in FIGS. 3, 4 and 5 the outer plate (10 in FIG. 1) extends below the outer edge of the personal watercraft. This extension traps water as a rudder would, creating resistance against the plate. This lateral resistance stops the rear of the craft from sliding in the opposite direction in which the craft is being steered.

A very important and unique feature of the outer plate (10 in FIG. 1) is its shape. This unique shape helps to eliminate a secondary and very detrimental reaction known as "sticking" in the aircraft industry. This "sticking" reaction occurs when fluid forces are in effect, the same as in similar air movement.

As the outer plate moves laterally while in a turn, if it were perfectly rectangular, a low pressure area down the center of the plate would form. This is due to fluid circulation off of the top and bottom edges. This low pressure area creates a suction that "sticks" the plate to the water. When coming out of a turn and returning to a straight course the craft has to be oversteered to break the plate loose. At this point there is a brief period of loss of control. During high speed manuevers, especially during competition this could be disastrous.

The design of my outer plate (10 in FIG. 1) with no sides being parallel discourages the alignment of any fluid circulation. This substantially reduces the formation of a low pressure area on the plate. The "sticking" situation has been reduced by an estimated 60%.

To further deal with the remaining 40% of this adhesion we have manufactured a plate using a textured finish. This finish containing literally thousands of minute vortex generators all but eliminate any suction on the outside of the plates. This finish as used in the aircraft industry creates very little, if any parasitic drag and does not affect the straight ahead maximum speed of the craft.

Summary, Ramifications, and Scope

I believe that the reader may see that the relatively simple installation of these devices on a personal watercraft will greatly enhance the maneuverability of the craft. The additional safety of operation due to more accurate steering control should be considered a major attribute of this invention.

Although the preceeding description contains many specifications, these should not be construed as limitations on the scope of the invention, but rather as an exemplification of one preferred embodiment thereof. Many other variations are possible. For example the elimination of the textured surface would detune the operation of this device but it would remain viable even with a smooth surface on the outer plates.

Accordingly, the scope of the invention should be determined not by the embodiment illustrated, but by the appended claims and their legal equivalents.

I claim:

1. An anti-spin and steering enhancement devise for jet powered personal watercraft compromising of a pair of wedge shaped outer plates extending below the rear left and right edges of the hull and a pair of spacers between the outer plates and the hull and a means for fastening said plates securely to the hull.

2. The device of claim 1 said outer and inner plates are composed of high density polyethelene.

3. The device of claim 1 said outer plate is of a vortex creating textured or pebbled finish.

4. The device of claim 1 said outer plate is a smooth finish not capable of producing vortexes.

5. The device of claim 1 said outer plate is designed with the top and bottom edges being non-parallel forming a wedge with rounded corners which reduces lateral adhesion to moving water.

6. The device of claim 1 the said outer and inner plates are mounted by one of either thru bolting, secured to existing studs and secured to existing threaded inserts in the hull.

* * * * *